US009410725B2

(12) United States Patent
Mitsubori

(10) Patent No.: US 9,410,725 B2
(45) Date of Patent: Aug. 9, 2016

(54) REFRIGERATOR INSTALLING STRUCTURE

(71) Applicant: SUMITOMO HEAVY INDUSTRIES, LTD., Tokyo (JP)

(72) Inventor: Hitoshi Mitsubori, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 300 days.

(21) Appl. No.: 13/747,644

(22) Filed: Jan. 23, 2013

(65) Prior Publication Data

US 2013/0192034 A1 Aug. 1, 2013

(30) Foreign Application Priority Data

Feb. 1, 2012 (JP) ..... 2012-020017

(51) Int. Cl.

| | |
|---|---|
| ***F25B 9/00*** | (2006.01) |
| ***F25B 41/04*** | (2006.01) |
| ***F25B 9/10*** | (2006.01) |
| ***F25D 19/00*** | (2006.01) |

(52) U.S. Cl.

CPC . *F25B 41/04* (2013.01); *F25B 9/10* (2013.01); *F25D 19/006* (2013.01); *Y10T 29/53552* (2015.01)

(58) Field of Classification Search

CPC ..... F25B 41/04; F25B 9/10; F25D 19/006; Y10T 29/53552; F16K 31/12

USPC ..... 62/6, 51.1

See application file for complete search history.

(56) References Cited

U.S. PATENT DOCUMENTS

| | | | | |
|---|---|---|---|---|
| 4,448,038 | A * | 5/1984 | Barbier | 62/212 |
| 5,944,285 | A * | 8/1999 | Royer et al. | 244/129.4 |
| 6,305,412 | B1 * | 10/2001 | Steele | 137/493.4 |
| 7,395,671 | B2 | 7/2008 | Miki | |
| 2005/0166600 | A1 * | 8/2005 | Mitsubori | 62/6 |
| 2009/0193816 | A1 | 8/2009 | Clayton et al. | |
| 2009/0277517 | A1 * | 11/2009 | Mann | 137/486 |

FOREIGN PATENT DOCUMENTS

| | | |
|---|---|---|
| JP | 05-018622 | 1/1993 |
| JP | H10-246547 | 9/1998 |
| JP | 2000-269022 | 9/2000 |
| JP | 2001-123951 | 5/2001 |
| JP | 3094239 U | 6/2003 |
| JP | 2004-053068 | 2/2004 |
| JP | 2005-322756 | 11/2005 |
| JP | 2007-005573 | 1/2007 |
| JP | 2007-127298 | 5/2007 |
| JP | 2009-178552 | 8/2009 |

* cited by examiner

*Primary Examiner* — Marc Norman
*Assistant Examiner* — Ana Vazquez
(74) *Attorney, Agent, or Firm* — IPUSA, PLLC

(57) ABSTRACT

A disclosed refrigerator installing structure that enables a refrigerator including a cylinder and a displacer to be installed in a vacuum vessel in which an object to be cooled is accommodated, the displacer being removed from the cylinder during maintenance, the cylinder being movable inside a sleeve between a position at which the cylinder thermally contacts the sleeve and another position at which the cylinder does not thermally contact the sleeve includes a discharge mechanism configured to discharge a gas inside a space formed between the sleeve and the cylinder if a pressure inside the space becomes greater than or equal to a predetermined pressure.

5 Claims, 5 Drawing Sheets

REFRIGERATOR INSTALLING STRUCTURE

CROSS-REFERENCE TO RELATED APPLICATIONS

This patent application is based upon and claims the benefit of priority of Japanese Patent Application No. 2012-020017 filed on Feb. 1, 2012, the entire contents of which are incorporated herein by reference.

BACKGROUND OF THE INVENTION

1. Field of the Invention

The present invention generally relates to a refrigerator installing structure. More specifically, the present invention relates to a refrigerator installing structure of accommodating a refrigerator inside a sleeve provided inside a vacuum vessel.

2. Description of the Related Art

For example, a Gifford-McMahon refrigerator (hereinafter, referred to as a "GM refrigerator" has been widely used as a means for cooling a cryostat (a cryo temperature vacuum vessel) such as a superconducting magnet apparatus. When such a GM refrigerator is used for a long time, maintenance is required.

In a method of maintaining the superconducting magnet apparatus or the like, the entire superconducting magnet apparatus is required to have an ordinary temperature. It takes from one day to six days to cause the temperature of the superconducting magnet apparatus to reach an ordinary temperature. In the meantime, because the superconducting magnet apparatus is continuously stopped under an idle condition, running efficiency of the superconducting magnet apparatus is greatly reduced.

Meanwhile, there is proposed a method of extracting a displacer while a cylinder of the GM refrigerator is fixed to the vacuum vessel. Within the method, the cylinder is continuously exposed to the air and the cylinder is continuously cooled by the vacuum vessel. Therefore, moisture in the air changes to be an ice film and adheres to the inner surface of the cylinder. Therefore, it is impossible to insert the displacer again inside the cylinder. Consequently, the maintenance becomes impossible.

Then, as a maintenance method by which the superconducting magnet apparatus or the like is maintained while preventing the ice film from adhering to the inner surface of the cylinder, there is proposed a method of forming a space separated from a vacuum zone of a vacuum vessel and installing a cylinder of the GM refrigerator in the space (Patent Document 1).

In this structure, when the GM refrigerator is installed in the sleeve, a cooling stage of the GM refrigerator is connected to an object to be cooled located inside the vacuum vessel via the sleeve. Further, the space is formed between the sleeve and a flange of the GM refrigerator. The space is vacuated. Further a sealing member (an O-ring) is provided between the sleeve and the cylinder so as to maintain a degree of vacuum in the space.

In the above structure, when the superconducting magnet apparatus or the like is maintained, a cylinder is separated from the sleeve by a small amount, e.g., several mm, thereby releasing a thermal connection between the cylinder and the sleeve is released. However, even if the cylinder is moved relative to the sleeve, sealing by the O-ring is ensured to thereby maintain a vacuum in the space formed between the sleeve and the cylinder.

As described, because the vacuum space exists between the sleeve and the cylinder and the sleeve and the cylinder are thermally separated, a low temperature of the vacuum vessel does not thermally conduct from the cylinder to the inside of the vacuum vessel. Therefore, the ice film, which causes a problem in the maintenance, does not adhere to the inside of the cylinder. The displacer can be easily replaced within a short time.

[Patent Document 1] Japanese Laid-open Patent Publication No. 2004-053068

SUMMARY OF THE INVENTION

According to an aspect of the present invention, there is provided a refrigerator installing structure that enables a refrigerator including a cylinder and a displacer to be installed in a vacuum vessel in which an object to be cooled is accommodated, the displacer being removed from the cylinder during maintenance, the cylinder being movable inside a sleeve between a position at which the cylinder thermally contacts the sleeve and another position at which the cylinder does not thermally contact the sleeve includes a discharge mechanism configured to discharge a gas inside a space formed between the sleeve and the cylinder if a pressure inside the space becomes greater than or equal to a predetermined pressure.

DETAILED DESCRIPTION OF THE PREFERRED EMBODIMENTS

According to the structure of installing a refrigerator of Patent Document 1, the temperature of the cylinder increases when the cylinder is separated from the cryo temperature vacuum vessel during the maintenance. In this case, if air or moisture is leaked into the space formed between the sleeve and the cylinder, the air or moisture frozen at a time of cooling is rapidly vaporized and expanded by the temperature increment of the cylinder. Therefore, there is a problem that the pressure inside the space formed between the sleeve and the cylinder rapidly increases to thereby damage the sleeve or the cylinder.

The present invention is provided in consideration of the above. The object of the present invention is to provide a refrigerator installing structure which can suppress a sudden increment of pressure inside the space formed between the sleeve and the cylinder.

A description is given below, with reference to the FIG. 1 through FIG. 5.

Figure 1:
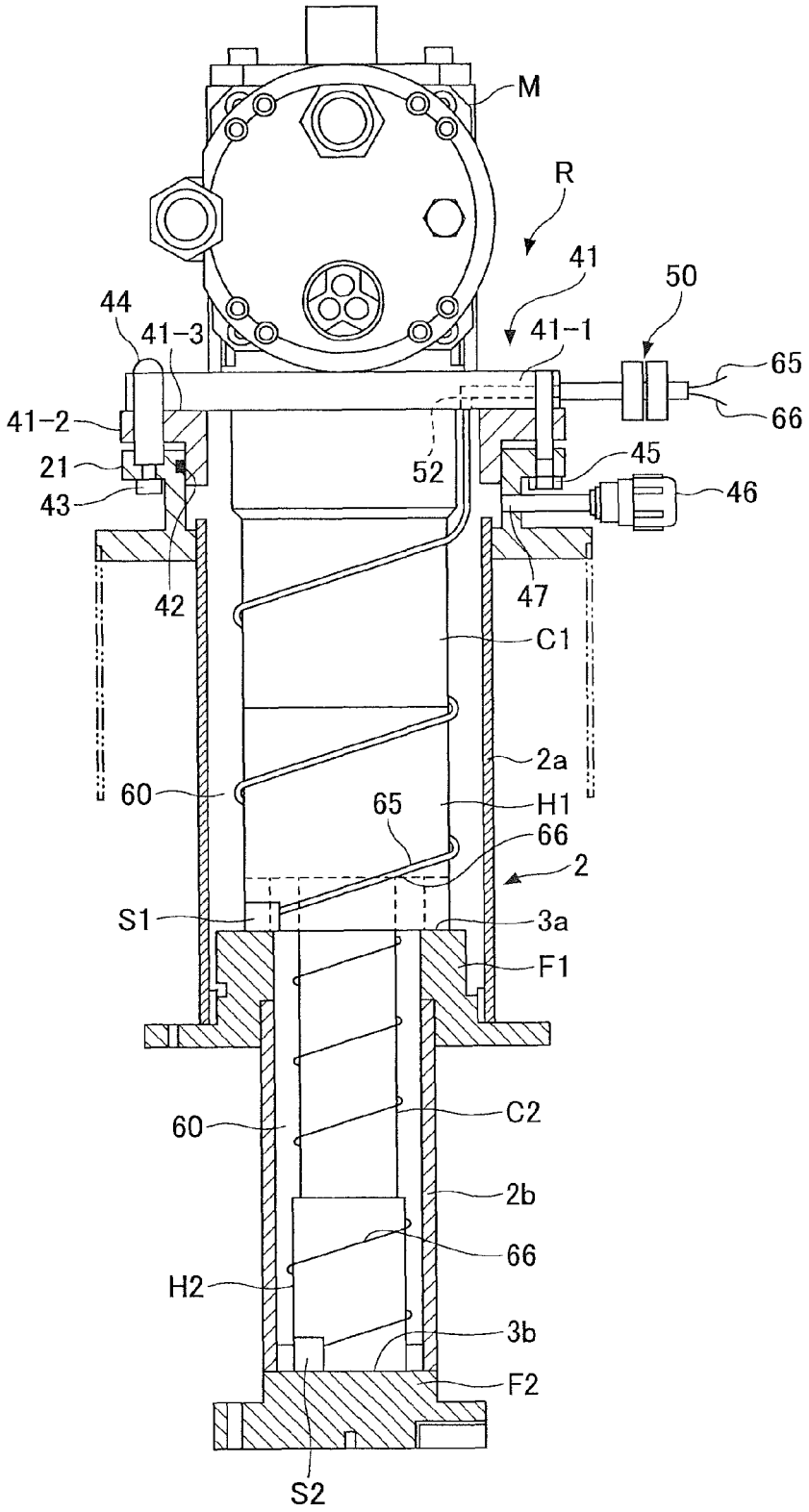
FIG. 1 is a cross-sectional view for illustrating a refrigerator installing structure as an embodiment of the present invention where a GM refrigerator is installed in a sleeve.
Figure 2:
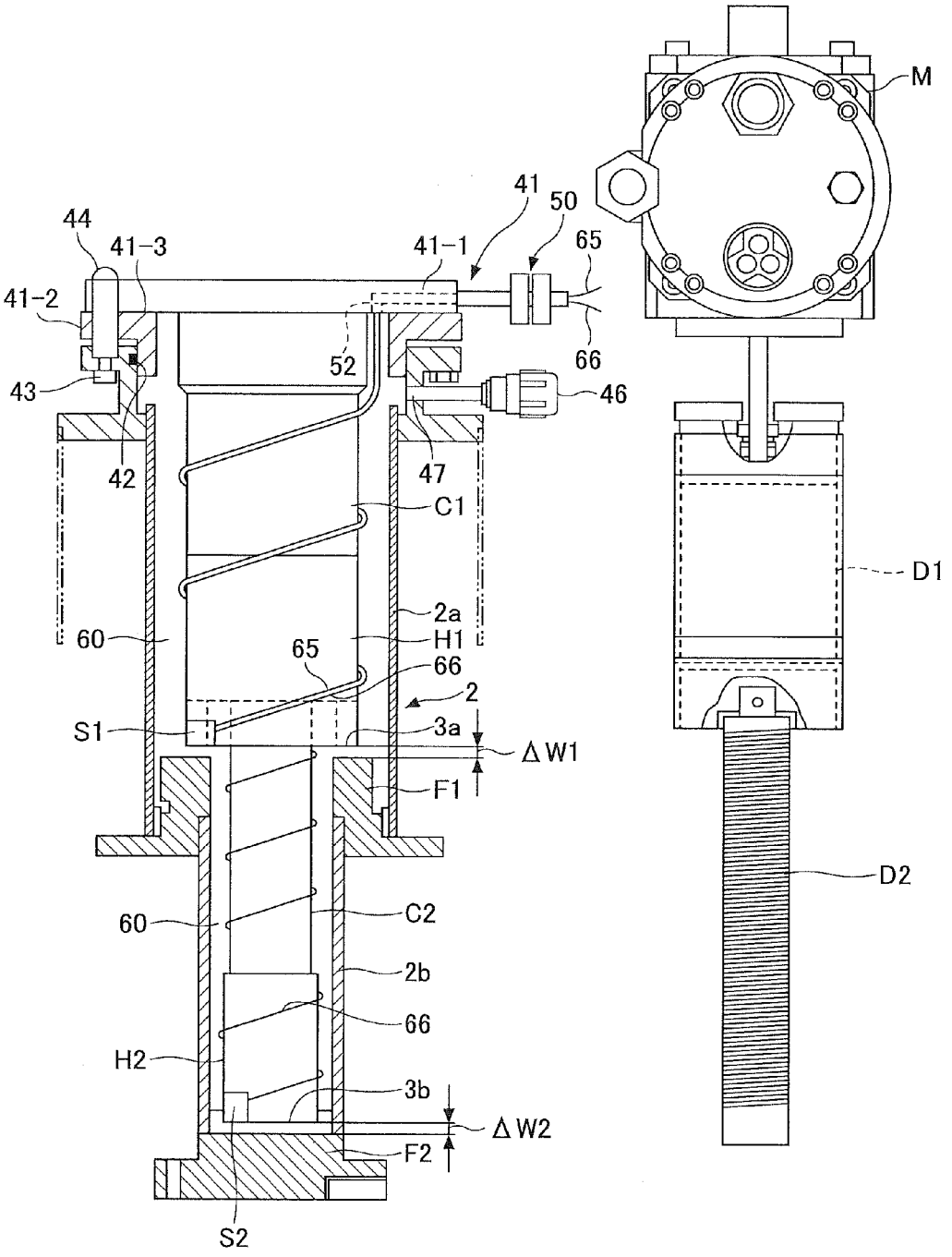
FIG. 2 is a cross-sectional view of the refrigerator installing structure of the embodiment of the present invention where displacers are removed from the cylinder.
Figure 3:
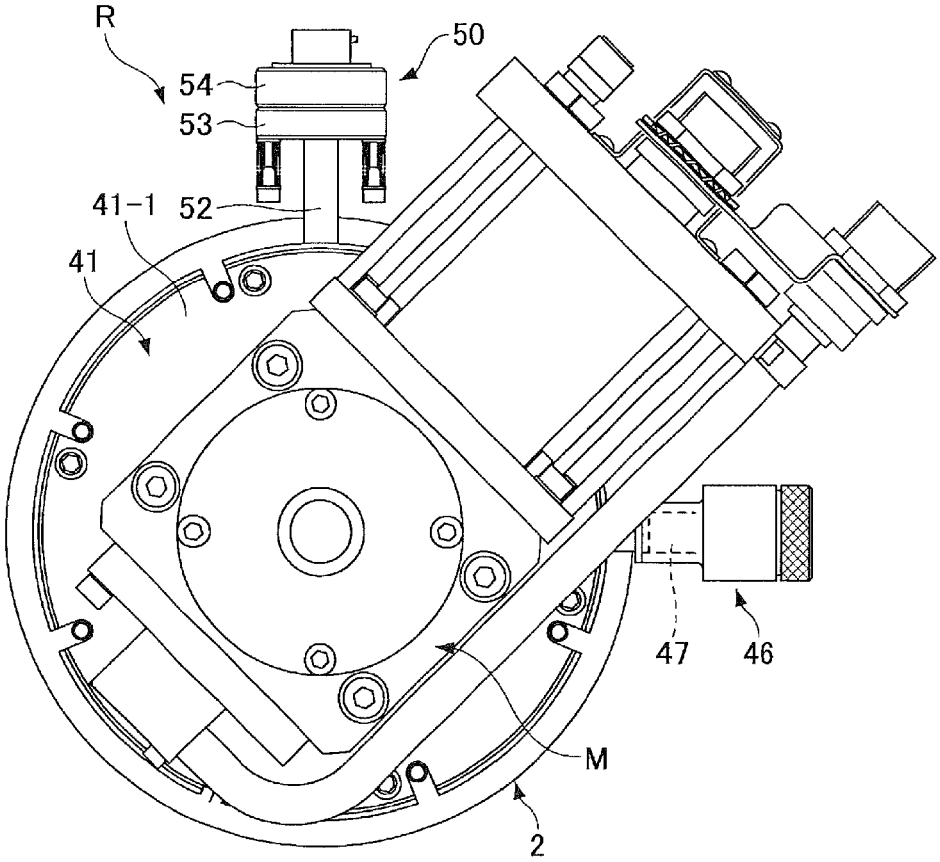
FIG. 3 is a plan view of a sleeve and a GM refrigerator installed in the sleeve.

FIGS. 1 to 3 illustrate a refrigerator installing structure of a first embodiment of the present invention. Within the embodiment, a Gifford-McMahon refrigerator R (hereinafter, referred to as a "GM refrigerator") is explained as an example. However, the present invention can be widely applied to a refrigerator having a structure where an internal portion is removed from a cylinder at a time of maintaining the refrigerator.

The GM refrigerator R cools an object to be cooled while the GM refrigerator R is inserted in a vacuum vessel (not illustrated), in which the object to be cooled is accommodated. Said differently, the GM refrigerator R is inserted into the vacuum vessel and the object to be cooled is accommodated in the vacuum vessel. The GM refrigerator R includes a motor driving unit M, displacers engaged with the motor driving unit M so as to be driven by the motor driving unit M, and cylinders accommodating the displacers so that the displacers can reciprocate inside the cylinders. Within the embodiment, the GM refrigerator is a two stage type. Therefore, a first stage cylinder C1, a second stage cylinder C2, a displacers D1, and a displacer D2 are included in the GM refrigerator R.

The present invention is not limited to the GM refrigerator R of the two stage type, and is applicable to a GM refrigerator R of a single stage type or a GM refrigerator R of a three or greater stage type.

A first stage cold head H1 is formed at the lower end of the first stage cylinder C1. A second stage cold head H2 is formed at the lower end of the second stage cylinder C2.

A flange 41 is formed in an upper opening periphery of the first stage cylinder C1. The flange 41 is provided to attach a motor driving unit M and the vacuum vessel to the upper opening periphery of the first stage cylinder C1. Specifically, the flange 41 lies between the first stage cylinder C1 and the vacuum vessel in order to attach the first stage cylinder C1 to the vacuum vessel via the flange 21. The displacers D1 and D2 are inserted into the first and second stage cylinders C1 and C2 via the opening of the flange 41.

The sleeve 2 includes a first stage sleeve 2*a* having a first stage cooling flange F1 at an lower end of the first stage sleeve 2*a* and a second stage sleeve 2*b* connected to the first stage cooling flange F1 at an upper end of the second stage sleeve 2*b* and having a second stage cooling flange F2 at an lower end of the second stage sleeve 2*a*. The flange 21 is provided at an opening periphery of the first stage sleeve 2*a* for attaching the first stage sleeve 2*a* to a top panel of the vacuum vessel.

Indium sheets 3*a* and 3*b* having thicknesses of about 0.5 mm to 1 mm are provided on a thermally contacting interface between a first stage cold head H1 of a GM refrigerator R and the first stage cooling flange F1 and a thermally contacting interface between a second stage cold head H2 and the second stage cooling flange F2, respectively, in order to further ensure thermal contacts.

The GM refrigerator R can achieve a cryo temperature of 40 K (degrees kelvin) to 70 K using the first stage cold head H1 and a cryo temperature of 4 K to 20 K using the second stage cold head H2. Therefore, the object to be cooled can be cooled to have a predetermined temperature by the first and second stage cold heads H1 and H2.

The first and second stage cylinders C1 and C2 forming the GM refrigerator R are installed inside the sleeve 2. In this installed state, a space 60 is formed between the inner surface of the sleeve 2 (the first and second stage sleeves 2*a* and 2*b*) and outer surfaces of the first and second stage cylinders C1 and C2 except for the thermally contacting interfaces. The thermally contacting interfaces are perpendicular to the extending direction of the first and second stage cylinders C1 and C2.

The flange 41 formed in an upper opening periphery of the first stage cylinder C1 faces the flange 21 of the sleeve 2. The flange 41 includes a plate member 41-1 in an annular shape and a cylindrical part 41-2. The plate member 41-1 is provided to attach the motor driving unit M to the first stage cylinder C1 while the displacers D1 and D2 are inserted into the first and second stage cylinders C1 and C2. The cylindrical part 41-2 is inserted into an upper portion of the sleeve 2 to seal a space inside the sleeve together with the plate member 41-1.

The plate member 41-1 and the cylindrical part 41-2 are integrated by a bolt (not illustrated) or the like. An O-ring 41-3 is provided at a joining portion between the plate member 41-1 and the cylindrical part 41-2. As described, the first and second stage cylinders C1 and C2 are accommodated in the sleeve 2 while the first and second stage cylinders C1 and C2 are separated from a vacuum zone inside the vacuum vessel.

An O-ring 42 made of rubber is provided on an inner peripheral surface of the flange 21 and a peripheral surface of the cylindrical part 41-2. The inner peripheral surface of the flange 21 and the peripheral surface of the cylindrical part 41-2 mutually face. The-ring 42 seals an interface between the cylindrical part 41-2 and an inner wall of the sleeve 2 (specifically, the flange 21) facing the inner wall of the sleeve 2.

As described below, the cylindrical part 41-2 can move upward and downward relative to the sleeve 2. Therefore, there is a small gap between the inner surface of the sleeve 2 (the flange 21) and the outer surface of the cylindrical part 41-2. The O-ring 42 is provided to prevent air, moisture or the like from intruding into the space 60 from the outside via the gap.

The flange 41 and the flange 21 are fastened by plural bolts 43 arranged at equal angular intervals. The bolts 43 are inserted on the lower side of the flange 21 to fasten the flange 21 and the flange 41. By a reason to be described below, the bolt 43 is inserted into the flange 21 with some looseness.

In addition, at least one guide pin 44 is provided to regulate inclinations of the first and second stage cylinders C1 and C2 when the cylindrical part 41-2 is inserted into the sleeve 2. In this embodiment, the number of the guide pins 44 is four. The four guide pins 44 are arranged at equal angular intervals of 90°. The guide pins 44 are arranged on the flange 21 in a standing state. The cylindrical part 41-2 and the plate member 41-1 have through holes at positions corresponding to the guide pins 44.

Spring washers 45 are interposed between the heads of some bolts 43 among the plural bolts 43 and the flange 21 facing the heads. The spring washers 45 generate a biasing force of pulling the flange 41 onto the lower side of the refrigerator R (as illustrated in FIG. 1) via the bolts 43.

Said differently, when the cooling is initiated, the first stage cylinder C1 begins to be cooled. Then, the first stage cylinder C1 contracts. With this, the first stage cold head H1 starts to move away from the first stage cooling flange F1. However, as stated, the first stage cylinder C1 is pushed down by the spring washers 45. Therefore, a surface contact between the first stage cold head H1 and the first stage cooling flange F1 (a thermal connection) is maintained.

The flange 21 includes a connector 46 and a vacuating port 47. One end of the vacuating port 47 communicates with the space 60 formed between the sleeve 2 and the first and second stage cylinders C1 and C2. The connector 46 is provided on the other end of the vacuating port 47. A depressurizing means such as a vacuum pump is connected to the connector 46. The depressurizing means performs vacuuming of the space 60.

A measurement port 52 is provided in the flange 41 (specifically, the plate member 41-1). An end of the measurement port 52 communicates with the space 60, and the other end of the measurement port 52 is extracted outside the plate member 41-1.

A first stage temperature sensor S1 is provided at a portion of the first stage cylinder C1 thermally contacting the first stage cooling flange F1. A second stage temperature sensor S2 is provided at a portion of the second stage cylinder C2 thermally contacting the second stage cooling flange F2. The first and second stage temperature sensors S1 and S2 are provided to detect cooling temperatures of the first and second stage cooling flanges F1 and F2, respectively.

Wirings 65 and 66 respectively connected to the first and second stage temperature sensors S1 and S2 are helically wound around the outer peripheries of the first and second stage temperature sensors S1 and S2, respectively. Further, the wirings 65 and 66 are outwardly pulled via the measurement port 52.

Figure 4:
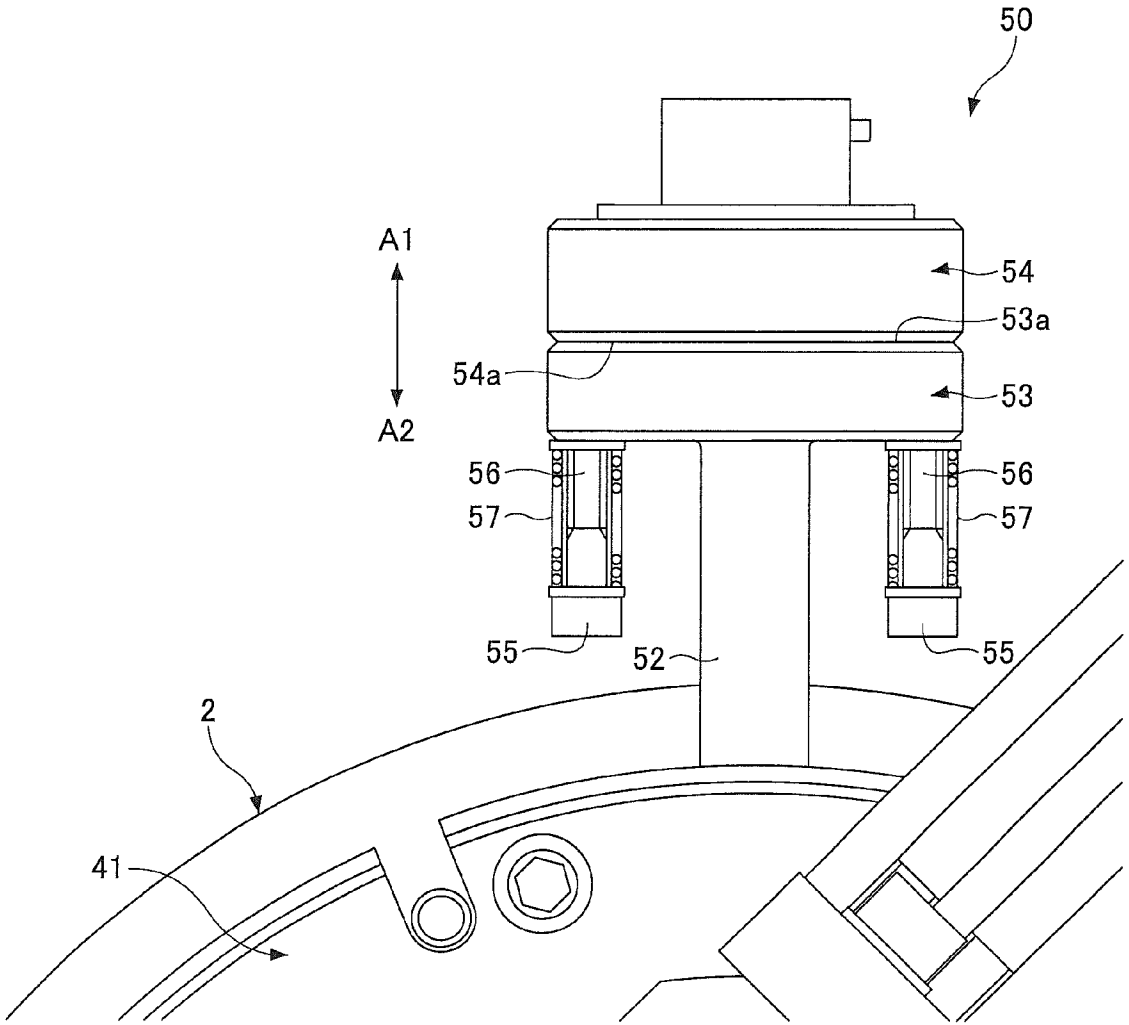
FIG. 4 is an enlarged view of a safety valve in a closed state.
Figure 5:
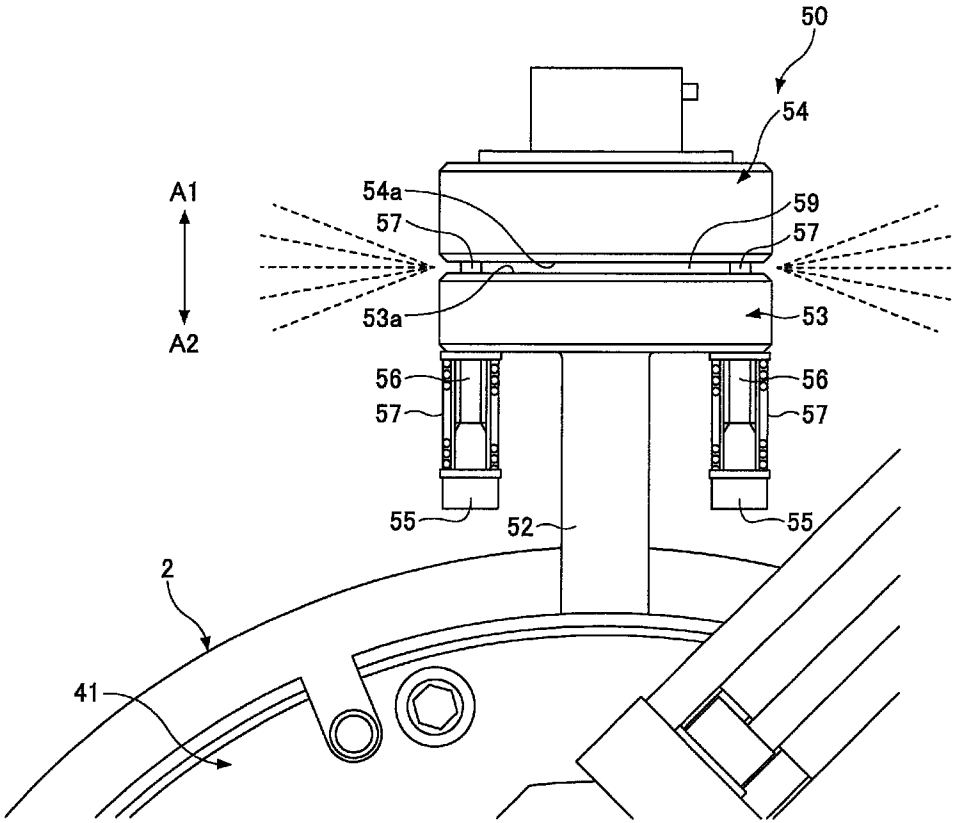
FIG. 5 is an enlarged view of a safety valve in an opened state.

Within the embodiment, the safety valve 50 (a discharge mechanism in the claims) is provided in the measurement port 52. FIGS. 4 and 5 are enlarged view of the safety valve arranged in the measurement port 52.

The safety valve 50 includes a fixed flange 53, a movable flange 54, bolts 55, springs 57 and so on. The fixed flange 53 is shaped like a disk and fixed by the measurement port 52 by welding or the like. Through holes (not illustrated) are formed at positions of the fixed flange 53 corresponding to the bolts 55. Further, a surface of the fixed flange 53 directing along an arrow A1 in FIG. 5 is a sealing surface 53*a*.

The movable flange 54 is shaped like a disk having the same diameter as that of the fixed flange 53. The movable flange 54 is movable in the directions of the arrows A1 and A2 relative to the fixed flange 53. The bolts 55 are screwed into the movable flange 54. Further, a surface of the movable flange 54 directing along the arrow A2 in FIG. 5 is a sealing surface 54*a*.

The heads of the bolts 55 are positioned on the side directed by the arrow A2 in FIG. 5. Columnar portions 56 of the bolts 55 extend in the direction along the arrow A1 from the heads. Threaded portions are formed in ends of the bolts 55 over the columnar portions 56. The threaded portions are screwed in internal thread portions formed in the movable flange 54. With this, the bolts 55 and the movable flange 54 are structured so as to be integrated.

Further, the columnar portions 56 are inserted into the through holes formed in the fixed flange 53. The diameter of the columnar portions 56 are smaller than the diameters of the through holes formed in the fixed flange 53. Therefore, the movable flange 54 is guided by the bolts 55 (specifically, the columnar portion 56) relative to the fixed flange 53 so as to be movable in the directions along the arrows A1 and A2.

The springs 57 are arranged between the fixed flange 53 and the heads of the bolts 55. The springs 57 are coil springs for biasing elastic force in directions of stretching the coil springs. Therefore, the movable flange 54 is placed in a position where the movable flange 54 contacts the fixed flange 53 by being pressed against the fixed flange 53.

As described, the fixed flange 53 has the sealing surface 53*a*, and the movable flange 54 has the sealing surface 54*a*. Therefore, since the movable flange 54 contacts the fixed flange 53 by being pressed against the fixed flange 53 by the elastic force of the springs 57, airtightness is ensured by the contact between the sealing surfaces 53*a* and 53*b* to properly close the fixed flange 53. Then, even if the measurement port 52 communicates with the space 60, air or moisture does not leak inside the space 60 from the measurement port 52.

Meanwhile, as described in detail later, if the pressure inside the space 60 becomes greater than or equal to a predetermined pressure, the movable flange 54 moves in the direction along the arrow A1 relative to the fixed flange 53. Said differently, if the pressure inside the space 60 increases, the pressure directly effects the sealing surface 54*a* of the movable flange 54. Along with the pressure increment inside the space 60, the force effecting on the sealing surface 54*a* exceeds the biasing force of the springs 57. At this time, movable flange 54 moves in the direction along the arrow A1 relative to the fixed flange 53.

Referring to FIG. 5, the movable flange 54 moves and is positioned apart from the fixed flange 53. By the movement of the movable flange 54, a gap 59 is formed between the sealing surface 53*a* and the sealing surface 54*a*. With this, the space 60 is opened to the air via the measurement port 52. A gas or the like inside the space 60 is discharged via the measurement port 52 and the safety valve 50. With this, the pressure inside the space 60 can be reduced.

Next, operations carried out in maintaining the refrigerator installing structure as configured above are described.

When the GM refrigerator R is maintained, the first and second stage cylinders C1 and C2 are maintained, and the motor driving unit M and the displacers D1 and D2 are replaced by a new motor driving unit M and new displacers D1 and D2.

During replacement operations, the fastening between the flanges 21 and 41 are released, and the GM refrigerator R is pulled up in a range of ensuring sealing by the O-ring 42 without totally extracting the GM refrigerator R from the sleeve 2 (said differently, without exposing the inside of the sleeve 2 to the air). The amount of pulling up the GM refrigerator R is, for example, about 2 mm to 3 mm indicated by arrows ΔW1 and ΔW2 in FIG. 2.

By this operation, the GM refrigerator R moves away from the sleeve 2 to cancel surface contacts (thermal connections) between the sleeve 2 and the first and second stage cold head H1 and H2. Thus, heat does not transfer on the thermally contacting interfaces.

Next, under the cryo temperature, the displacers D1 and D2 are extracted together with the motor driving unit M while the first and second stage cylinders C1 and C2 are fixed as is. Thereafter, the new displacers D1 and D2 and the new motor driving unit M are installed.

Referring to FIG. 2, the motor driving unit M is extracted together with the displacers D1 and D2, and the surface contacts (the thermal connections) between the sleeve 2 and the first and second stage cylinders C1 and C2 are released.

While the surface contacts are released, the first stage sleeve 2*a* and the first stage cold head H1 are thermally separated, and the second stage sleeve 2*b* and the second stage cold head H2 are thermally separated. Further, the space 60 is depressurized by the depressurizing means via the connector 46. Thus, the space 60 maintains a vacuum.

Next, the new motor driving unit M and the new displacers D1 and D2 are installed inside the first and second stage cylinders C1 and C2. However, when the old motor driving unit M and the old displacers D1 and D2 are removed, the first and second stage cylinders C1 and C2 are exposed to the air. Because the temperature of the inside of the first and second stage cylinders C1 and C2 is low, an ice film or frost is formed on the inner surfaces of the first and second stage cylinders C1 and C2.

Therefore, it is difficult to install the motor driving unit M and the displacers D1 and D2 in the first and second stage cylinders C1 and C2. Because of this, the inside of the first and second stage cylinders C1 and C2 is heated.

In heating the inside of the first and second stage cylinders C1 and C2, a heating device (e.g., a dryer) is inserted into the cylinders C1 and C2 to increase the temperature. Thus, the ice film or frost is removed and cleaned. The increased temperature is about 20° C. to 40° C. After heating the inside of the first and second stage cylinders C1 and C2, the indium sheets 3*a* and 3*b* attached to lower end surfaces of the first and second cold heads H1 and H2 are softened.

After completing the heating, the new motor driving unit M and the new displacers D1 and D2 are inserted inside the first and second stage cylinders C1 and C2. The pulled-up first and second stage cylinders C1 and C2 are pulled down to be in an original state as illustrated in FIG. 1. Thus, a performance of heat transfer in the first and second stage cold heads H1 and H2 can be similar to that in the original first and second stage cold heads H1 and H2 in the brand-new state before the replacement.

As described, in the refrigerator installing structure of the embodiment, the space 60 being vacuum exists between the sleeve 2 and the first and second stage cylinders C1 and C2. Further, the surface contacts (the thermal connections) between the sleeve 2 and the first and second stage cylinders C1 and C2 are canceled.

Therefore, the first and second stage cylinders C1 and C2 are not directly cooled by the low temperature on the side of the vacuum vessel. Further, the first and second stage cylinders C1 and C2 are exposed to the air by removing the displacers D1 and D2. However, the existence of the space 60 prevents heat from intruding toward the vacuum vessel via the first and second stage cylinders C1 and C2. Thus, the temperature increment of the vacuum vessel can also be prevented.

Because the space 60 formed between the sleeve 2 and the first and second stage cylinders C1 and C2 is vacuum, air, moisture or the like likely intrude thereinto from the outside. Further, vibration occurs by driving the motor driving unit M. Therefore, the sealing property may degrade over a period of time. Because of these reasons, air, moisture or the like may leak (intrude) into the space 60. If the air, moisture or the like leaks into the space 60, since the sleeve 2 and the cylinders C1 and C2 are in a cryo temperature state, the inner wall of the sleeve 2 and the outer walls of the first and second stage cylinders C1 and C2 catches ice so that the ice is accumulated on the inner wall and the outer walls.

When the maintenance is done while the leaked air, moisture or the like freezes and are caught by the inner wall of the sleeve 2 and the outer walls of the first and second stage cylinders C1 and C2, the first and second stage cylinders C1 and C2 are thermally separated from the sleeve 2 maintained to be cooled, and are exposed to the air. Therefore, the temperature of the first and second stage cylinders C1 and C2 increases. Along with the temperature increment, the frozen air, moisture or the like is vaporized and expands to thereby rapidly increase the pressure inside the space 60. Specifically, when the air, moisture or the like is vaporized and expands, the pressure inside the space 60 increases greater than or equal to, for example, 400 times in comparison with the pressure before increasing the temperature.

However, in the refrigerator installing structure of the embodiment, the safety valve 50 is provided in the measurement port 52 communicating with the space 60. Therefore, if the pressure inside the space 60 increases, the increased pressure is applied to the movable flange 54 forming the safety valve 50. Then, the increased pressure biases to move the movable flange 54 in the direction along the arrow A1.

When the pressure inside the space 60 becomes a predetermined pressure or greater, the movable flange 54 moves against the elastic force of the springs 57, as described with reference to FIG. 5. Thus, the safety valve 50 is opened to enable the vaporized and expanding gas inside the space 60 to be discharged from the gap 59 to the outside.

In the refrigerator installing structure, the predetermined pressure is set in a pressure range without causing the first and second stage cylinders C1 and C2 to move relative to the sleeve 2 even if the pressure increases and stays within a pressure range that will not cause damages in the sleeve 2, the first and second stage cylinders C1 and C2, the O-ring 42 and so on due to the pressure increment. The predetermined pressure in the safety valve 50 can be changed by adjusting the spring constant of the springs 57, the areas of the sealing surfaces 53*a* and 53*b*, or the like.

As described, in the refrigerator installing structure of the embodiment, even if air, moisture or the like leaks into the space 60, it is possible to prevent the damages from occurring in the sleeve 2, the first and second stage cylinders C1 and C2, the O-ring 42, or the like during the maintenance. Further, along with the pressure increment inside the space 60, it is possible to prevent the first and second stage cylinders C1 and C2 from being separated from the sleeve 2. Thus, safety of the maintenance operations can be enhanced.

Within the embodiment, the measurement port 52 conventionally used is utilized, and the safety valve 50 is provided in the measurement port 52. Meanwhile, it is also possible to form a port communicating with the space 60 in addition to or instead of the measurement port 52 and provide a safety valve in the port.

However, in a case where the structure is employed, the number of the parts increases and the refrigerator installing structure becomes complicated. Therefore, as described in the embodiment, when the measurement port 52 is utilized and the safety valve 50 is provided in the measurement port 52, it is possible to simplify the refrigerator installing structure and lower the cost of the refrigerator installing structure.

Further, as the port communicating with the space 60, a vacuating port 47 used to vacuate the space 60 is provided in addition to the measurement port 52. However, in the embodiment, the safety valve 50 is provided in the measurement port 52 without providing the safety valve 50 in the vacuating port 47.

According to the structure, in a case where the pressure inside the space 60 increases, the gas inside the space 60 can be discharged via the safety valve and the measurement port 52. Further, the gas inside the space 60 can be discharged via the connector 46 and the vacuating port 47. Thus, the gas inside the space 60 can be efficiently discharged.

The refrigerator installing structure of the embodiment of the present invention can be used for a superconducting magnet apparatus provided for a monocrystal puller, a superconducting magnet apparatus for other usage, or the like.

According to the embodiment of the present invention, when the pressure inside the space formed between the sleeve and the first and second stage cylinders increases greater than or equal to the predetermined pressure, the gas inside the space is discharged by a discharge mechanism. Therefore, it is possible to prevent the sleeve and the first and second stage cylinders from being damaged.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the refrigerator installing structure has been described in detail, it should be understood that the various changes, substitutions, and alterations could be made hereto without departing from the spirit and scope of the invention.

What is claimed is:

1. A refrigerator installing structure that enables a refrigerator including a cylinder and a displacer to be installed in a vacuum vessel in which an object to be cooled is accommodated, the displacer being removed from the cylinder during maintenance, the cylinder being movable inside a sleeve between a position at which the cylinder thermally contacts the sleeve and another position at which the cylinder does not thermally contact the sleeve, the refrigerator installing structure comprising:

a discharge mechanism configured to discharge a gas inside a space formed between the sleeve and the cylinder if a pressure inside the space becomes greater than or equal to a predetermined pressure, and the discharge mechanism provided in a measurement port which is provided in the refrigerator so as to cause the space to communicate with an outside space outside the refrigerator installing structure, the discharge mechanism including a first flange portion which is shaped like a disk, has a first sealing surface, and is rigidly fixed by welding to the measurement port, a second flange portion which is shaped like a disk having a same diameter as that of the first flange portion, has a second sealing surface, and is movable relative to the first flange portion so as to close the measurement port by contacting the first flange portion or open the measurement port by being separated from the first flange portion, the second flange portion being guided by a bolt fixed to the second flange portion when the second flange portion moves relative to the first flange portion, and a spring which causes the second sealing surface of the second flange portion to contact the first sealing surface of the first flange portion by an elastic force of the spring of pressing the second flange portion so as to close the measurement port, wherein the spring is configured to enable the second flange portion to be separated from the first flange portion when the pressure inside the measurement port becomes the predetermined pressure.

2. The refrigerator installing structure according to claim 1, wherein the discharge mechanism is provided at a position different from a position of a vacuating port, which is provided in the vacuum vessel, so as to communicate with the space for depressurizing the space.

3. The refrigerator installing structure according to claim 1, wherein discharge mechanism is a safety valve which opens when the pressure inside the space becomes greater than or equal to the predetermined pressure.

4. The refrigerator installing structure according to claim 1, wherein the spring is arranged between the first flange portion and a head of the bolt.

5. The refrigerator installing structure according to claim 1, wherein the discharge mechanism further includes a first temperature sensor thermally contacting the first flange portion, a second temperature sensor thermally contacting the second flange portion, and first and second wirings respectively connected to the first and second temperature sensors, the first and second wirings being outwardly pulled through the measurement port.

* * * * *